United States Patent [19]

Akkerman

[11] Patent Number: 4,776,397

[45] Date of Patent: Oct. 11, 1988

[54] TOOL FOR LOWERING INTO CENTERED POSITION WITHIN A WELL BORE

[75] Inventor: Neil H. Akkerman, Houston, Tex.

[73] Assignee: AVA International Corporation, Houston, Tex.

[21] Appl. No.: 915,380

[22] Filed: Oct. 6, 1986

[51] Int. Cl.[4] ..... E21B 17/10

[52] U.S. Cl. ..... 166/241; 175/325

[58] Field of Search ..... 166/241, 113; 175/325

[56] References Cited

U.S. PATENT DOCUMENTS

| | | | |
|---|---|---|---|
| 3,915,229 | 10/1975 | Nicolas | 166/241 |
| 3,978,924 | 9/1976 | Roesner | 166/241 |
| 4,557,327 | 12/1985 | Kinley et al. | 166/241 |
| 4,619,322 | 10/1986 | Armell et al. | 166/241 |

*Primary Examiner*—Jerome Massie IV
*Assistant Examiner*—Bruce M. Kisliuk
*Attorney, Agent, or Firm*—Vaden, Eickenroht, Thompson & Boulware

[57] ABSTRACT

There is disclosed a tool which is adapted to be lowered and raised through a well conduit into and out of a centered position within a well bore beneath the lower end of the conduit. The tool has arms which are spring pressed toward outer positions for engaging the well bore, but held in inner positions in which they may move vertically through the well conduit until the tool has been lowered into a bore near the lower end of the well conduit, and then returned to and reheld in such position upon raising of the tool above the bore during retrieval of the tool.

8 Claims, 4 Drawing Sheets

TOOL FOR LOWERING INTO CENTERED POSITION WITHIN A WELL BORE

This invention relates generally to a tool which is adapted to be held in a centered position within a well bore. More particularly, it relates to an improved tool of this type which may be lowered into and raised from a centered position within a well bore beneath the lower end of a well conduit within the well bore.

In one tool usable for this purpose and commonly known as a "centralizer", bow springs are mounted in circumferentially spaced relation about a body adapted to be moved vertically through the well conduit on a wire line, with one or both ends of each spring being free to move relatively with respect to the body and the intermediate portion thereof being sized for yieldably engaging the well bore. Because of the low spring rate of the bow springs, this type of tool is especially well suited for locating an object which must be lowered and then raised through areas within the conduit of enlarged diameter, such as side pocket mandrels in a tubing string, into which the springs may move. On the other hand, the lower rate of the springs may make this type of tool unsuitable for centering an object such as an electronic instrument whose longitudinal axis must be fixedly located against vibrations and other phenomena tending to displace it.

In another tool usable for this purpose, arms are mounted on and so connected to the body and one another as to move between inner positions in which they may move vertically through the well conduit and outer positions in which their outer ends engage the well bore in circumferentially space relation. More particularly, the arms are spring pressed toward outer position and so sized that, when their outer ends engage the well bore, they extend at a relatively large angle to the vertical so as to engage it with a large horizontal force. Although useful in more firmly locating the object with its axis in a fixed longitudinal position, this type of tool is more susceptible to becoming caught in enlarged diameter areas during installation or retrieval of the object.

The primary object of this invention is to provide such a tool which has little tendency to become caught during installation or retrieval, but which nevertheless is adapted to more firmly center the longitudinal axis of the object within the well bore.

A more particular object is to provide such a tool having arms which are held in retracted or inner positions, during lowering of the body to or raising of the body from located positions within a well conduit within a well bore, then released for expansion outwardly to center the body within the well bore when lowered beneath the lower end of the conduit, and finally returned to their inner positions, in the event the tool is to be retrieved, merely in response to raising of the tool out of centered position and into and through the well conduit.

U.S. Pat. No. 4,522,259 shows and describes a landing tool comprising a wire line manipulatable body having parts thereon which are moved into and held within a locking groove in a well conduit in response to lowering of the tool into a cylindrical bore of predetermined diameter less than that of the bore thereabove, and then released for movement out of the groove in response to raising of the tool above the bore. Thus, the body carries sensors for radial movement between outer positions in which they extend from the body in order to sense its entry into the bore of predetermined diameter, and inner positions to which they are moved as they are lowered within the bore. When so moved, the sensors release parts of the tool body for movement to positions in which the locking parts are forced into and then hold in locking positions. Then, upon raising of the tool to lift the sensors above the bore, the body parts are moved to positions which permit the locking parts to be retracted from locking positions and the tool to be retrieved.

A more particular object of the above described invention is to provide a tool of this type in which the arms are released in response to the lowering of sensors into a bore of predetermined diameter near the lower end of the conduit, and then reheld in their inner positions in response to raising of the sensors above such bore during retrieval of the tool.

These and other objects are accomplished, in accordance with the illustrated embodiment of this invention, by a tool which, as in to one of the types above described, comprises a wireline manipulatable tool adapted to be moved vertically through the well conduit, a plurality of arms mounted on the body for movement between inner positions in which their outer ends may pass vertically within the well conduit and outer positions in which they engage the well bore in circumferentially spaced apart, and means which yieldably urges the arms toward their outer positions. In accordance with the novel aspects of the present invention, however, the tool also includes a means for sensing the entry of the body into a bore of the well conduit near its lower end, together with means for holding the arms in their inner positions, as the body is lowered within the well conduit and into the bore, and then, when the arms are below the lower end of the well conduit and the sensing means is in the bore, releasing said arms for movement by the urging means to their outer positions. More particularly, the arms are forced to their inner positions when raised with the body against the lower end of the well bore, in order to retrieve the tool, and the holding means is returned to its holding position upon continuing raising of the body to a position in which the sensing means moves out of the bore.

Thus, the arms are maintained in their inner positions as they move vertically within the well conduit, even though they may traverse an enlarged area within the well conduit or the sensing means of the tool enters a bore of the well conduit having the same characteristics as the bore near its lower end. That is, the arms are released for movement to their outer positions only in the event both conditions prevail in that the arms are below the lower end of the well conduit, or an enlargement in the well conduit, and the sensing means is within the bore which releases the arms for movement to their outer positions. As a result, the arms are retained in the their inner positions not only during lowering of the tool into its centered position, but also upon raising it from its centered position, except in the unlikely situation in which both such unexpected conditions might occur.

In the illustrated embodiment of the invention, the body includes a first wire line manipulatable part on which the arms are mounted for movement between their inner and outer positions, and a second part moveable with respect to the first part and connected to the arms for moving them to their outer positions, upon movement in one direction in respect to the first part, and to their inner positions upon movement with respect thereto in the opposite direction, the yieldably urging means acting between the first and second parts to urge the second part in said one direction and thus urge the arms toward their outer position. More particularly, in the preferred and illustrated embodiment of the invention, the arms are pivotally mounted on the second body part, and the connecting means comprises gear teeth formed on each arm concentrically of its pivotal axis, and a rack on the second body part having gear teeth drivingly engageable with the gear teeth on each arm. Each arm pivots in a direction upwardly and outwardly upon movement to its outer position and means are provided for limiting movement of the second part with respect to the first part so as to prevent movement of the arms to positions in which their outer ends are above their pivotal axis. Hence, even if the arms would move within an unexpectedly enlarged portion of the well bore, they would not be permitted to move over center to a position in which it might be difficult to retrieve the tool.

In the illustrated and preferred embodiment of the invention, the bore is of a predetermined diameter less than the diameter of the well conduit thereabove, and the means for sensing entry of the body into the bore comprises sensors carried by the first body part for movement between inner and outer positions with respect to the outside of the first part in response to movement into and out of the bore. The holding and releasing means comprises means carried by the second body part for movement between an expanded position in which it is disposed between oppositely facing shoulders on the body parts so as to limit movement of the second part in said one direction, and a contracted positions in which it is free to move past the shoulder on the first body part, whereby said second body part may move in the one direction in order to move the arms to their outer positions. The expandable and contractible means is disposed opposite the sensors and normally assumes its expanded position to urge the sensors outwardly to sensing position, when they are out of the bore, but is forced inwardly to its contracted position by the sensors as the sensors enter the bore. More particularly, the first body part has a groove thereabout, the expandable and contractible means comprises a C-ring which is carried in the groove, the second body has a groove thereabout opposite the sensors, and the shoulder on the first and second body parts are formed on the grooves therein. Preferably, the shoulders are spaced a distance sufficiently greater than the length of the C-ring to permit the ends of the arms to move out to engage a somewhat larger bore in the conduit than the bore in the lower end there of without releasing the C-ring for movement past the shoulder on the first body part.

In the drawings, wherein like reference characters are used throughout,

Figure 5A:
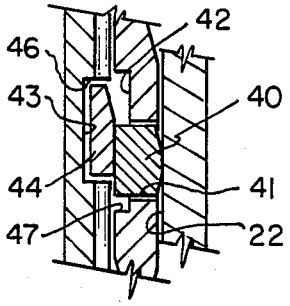
Figure 5:
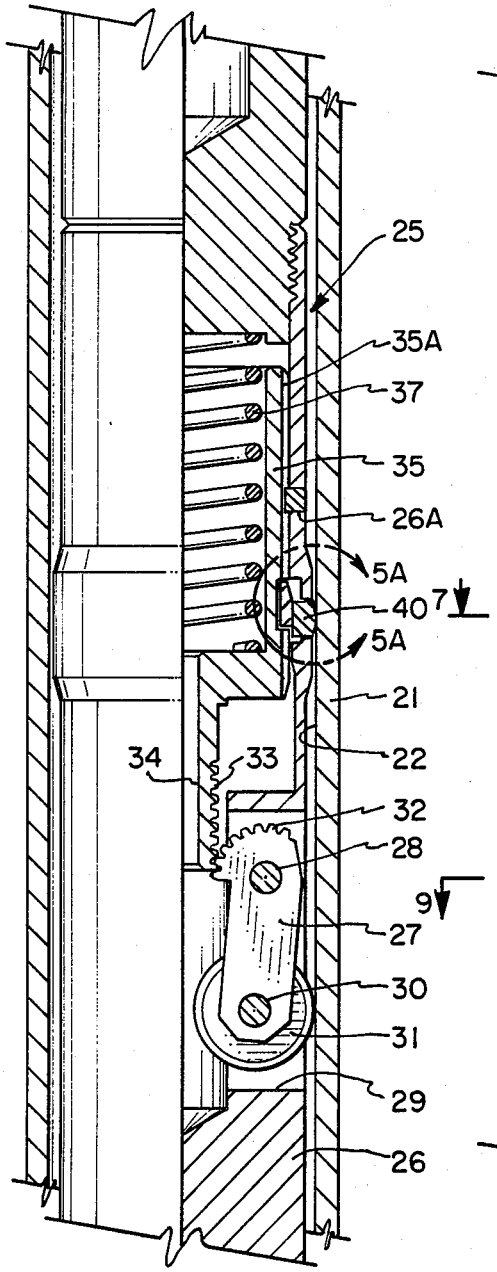
Figure 3:
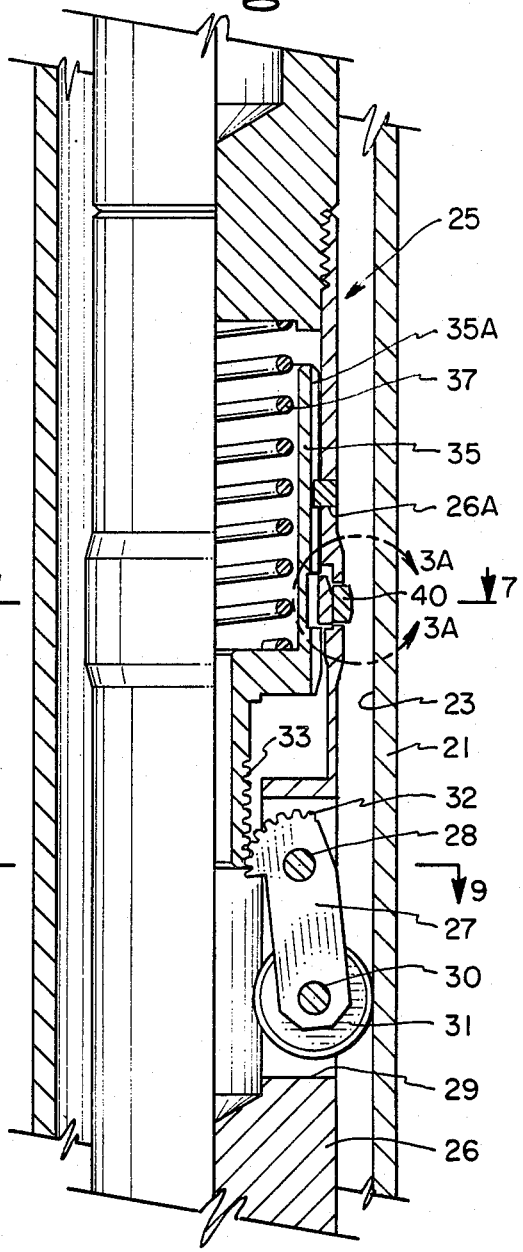
Figure 4A:
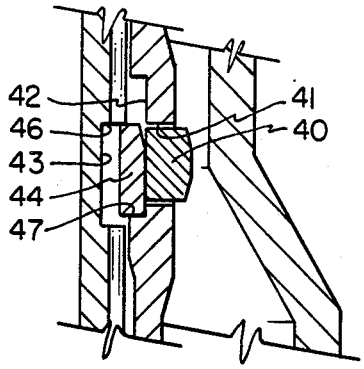
Figure 4:
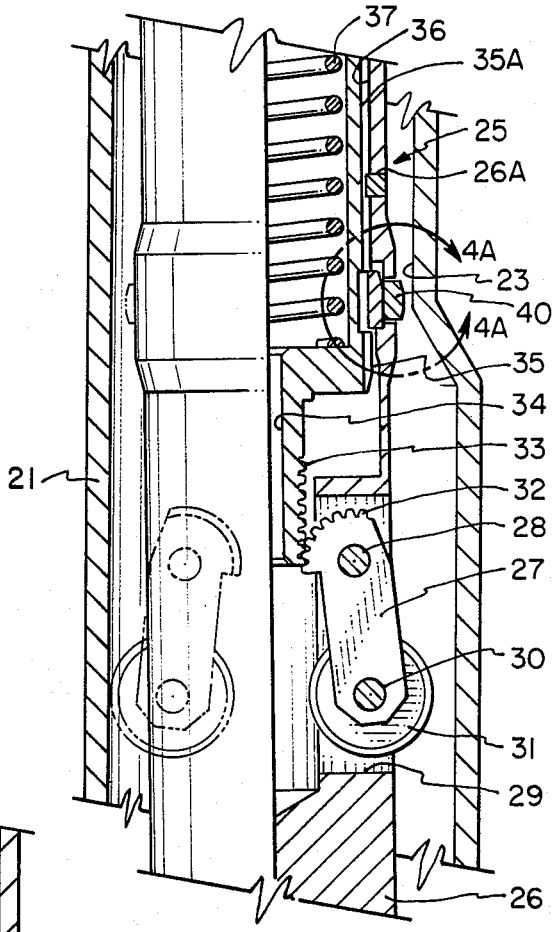
Figure 6:
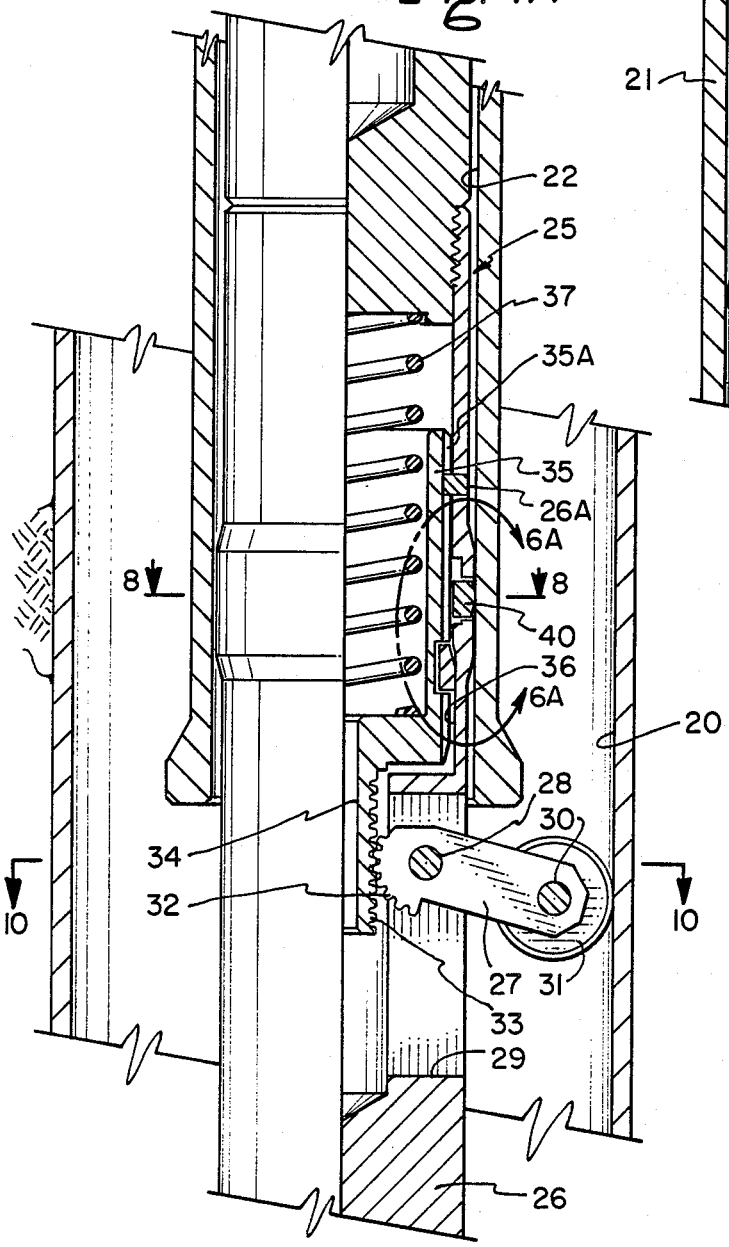
Figure 6A:
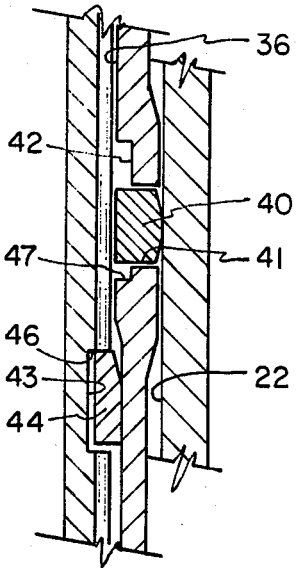
Figure 7:
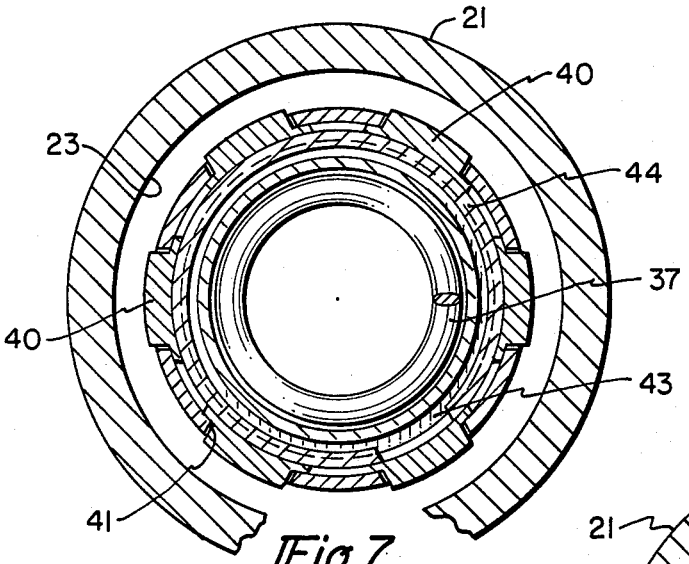
Figure 8:
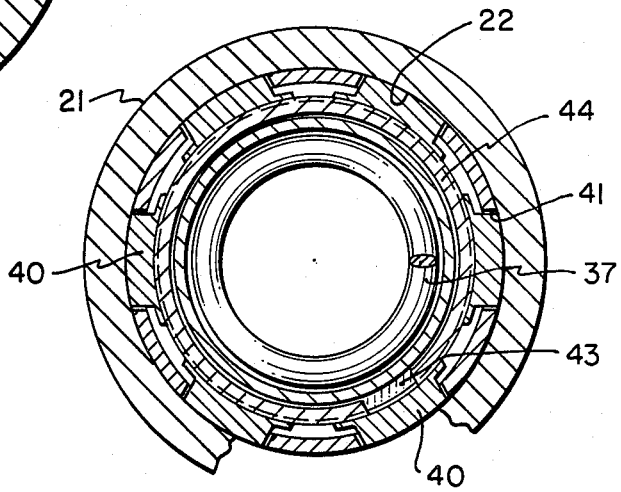
Figure 10:
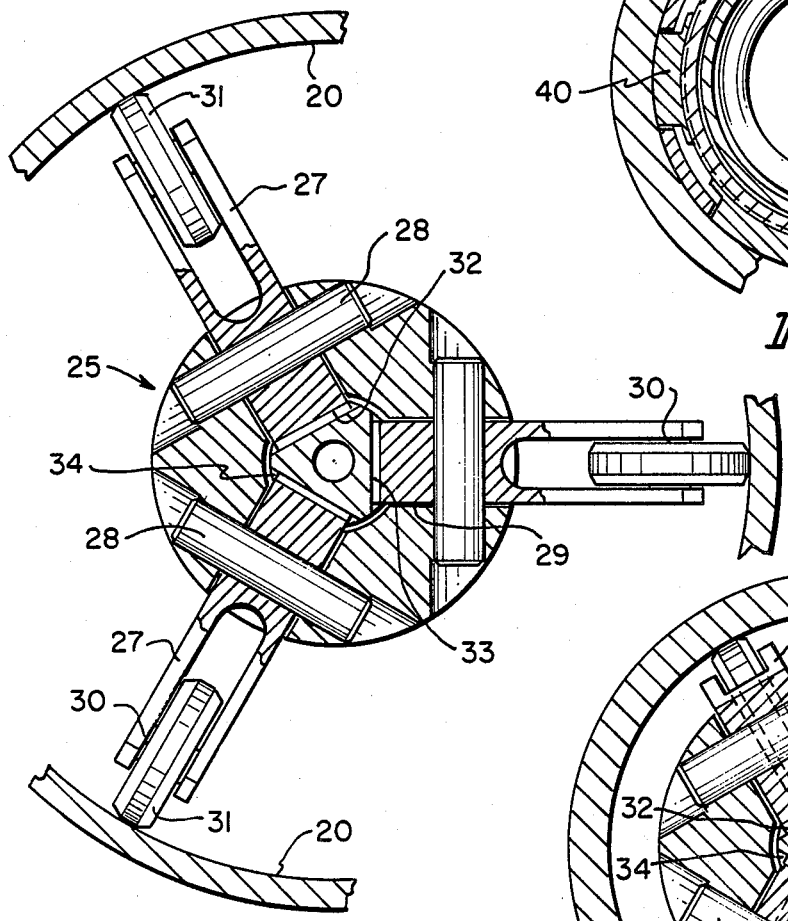
Figure 9:
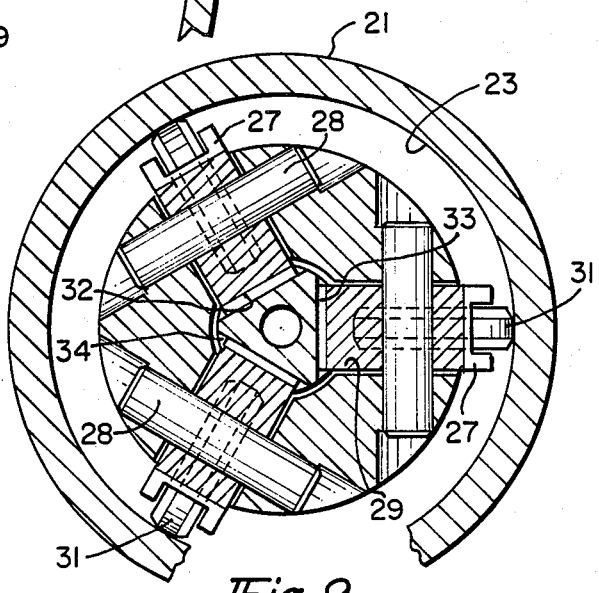

FIG. 3 is a view of the upper end of the tool, with the left hand side thereof shown in elevation and the right hand side being shown in section, and during movement of the arms through a portion of the well conduit above the bore of somewhat larger inner diameter than the bore so that the sensors move outwardly in non-sensing position, and with the outer ends of the arms yieldably urged outwardly to engage the larger inner diameter portion of the well conduit;

FIG. 4 is view similar to FIG. 3, but in which the arms have entered an enlarged bore of the well conduit, such as a side pocket mandrel, the outer ends of the arms nevertheless being held against outward movement from their inner positions;

FIG. 5 is a view of the tool similar to FIGS. 3 and 4, but upon entry of the sensors into the bore in the lower end of the well conduit and engagement of the outer ends of the arms with the bore to hold them in their innermost inner positions;

FIG. 6 is a further view of the tool similar to FIGS. 3 to 5, but wherein the tool has been lowered further to permit its arms to move out the lower end of the well conduit and the outer ends of the arms to be urged outwardly into engagement with the well bore;

FIGS. 3A, 4A, 5A and 6A are enlarged detailed views of the parts of the tool indicated by the same symbols in FIGS. 3, 4, 5 and 6, respectively;

FIG. 7 is a cross sectional view of the tool with the sensors and non-sensing positions, as seen along broken lines 7—7 of FIG. 3;

FIG. 8 is another cross sectional view of the tool, but with the sensors moved to sensing position, as seen along broken lines 8—8 of FIG. 6;

FIG. 9 is a cross sectional view of the tool showing the arms in inner positions, as seen along broken lines 9—9 in FIG. 3; and FIG. 10 is a cross sectional view of the tool, showing the arms in their outer positions, as seen along broken lines 10—10 of FIG. 6.

With reference now to the above described drawings, the well bore is shown to be lined with casing 20, and the well conduit to comprise a string of tubing 21 suspended therein from the head of the well (not shown). The lower end of the tubing has a bore 22 of somewhat lesser diameter than a bore 23 thereabove, which may extend throughout the remainder of the tubing, except for enlargements therein as shown, for example, by the side pocket mandrel in FIG. 4. Thus the bore 22 in the lower end of the well tubing is the smallest bore throughout its length, and thus, as will be understood from the description to follow, the only bore which will be sensed by the sensors carried by the tool.

Figure 1:
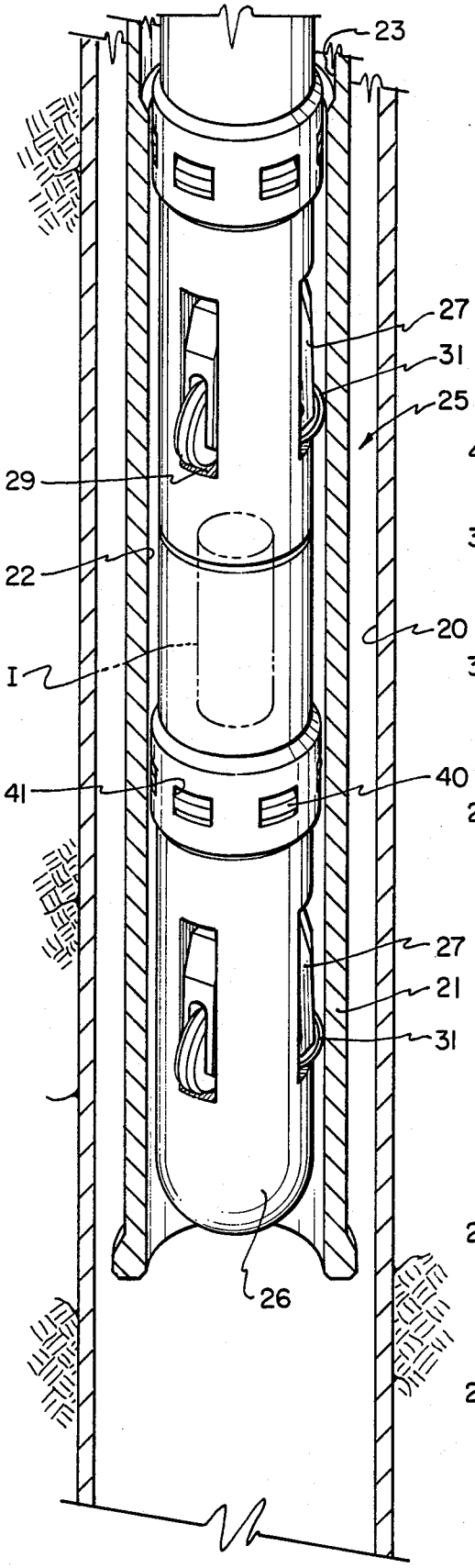
FIG. 1 is a vertical sectional view of a well conduit extending within a well bore, and a perspective view of a tool constructed in accordance with the present invention lowered to a position within the well conduit in which the sensors thereon have entered the bore of predetermined diameter near its lower end.
Figure 2:
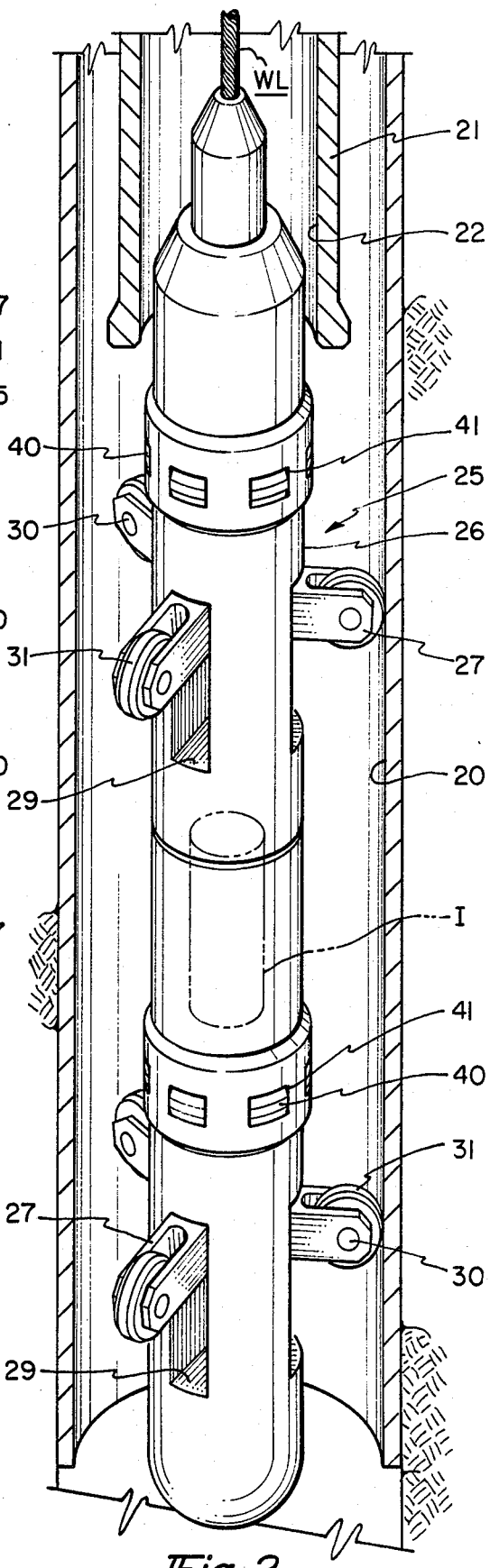
FIG. 2 is a view similar to FIG. 1, but wherein the tool has been further lowered into the well bore beneath the lower end of the conduit and the outer ends of its arms have been moved outwardly into engagement with the well bore to hold the tool in centered position.
Figure 3A:
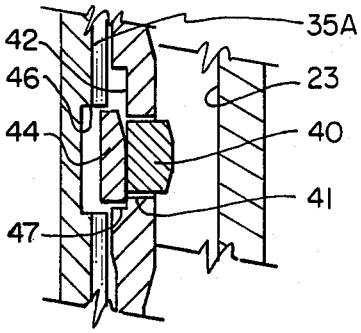

The tool comprises a body 25 which includes a first part 26 having its upper end connected to a wire line WL (FIG. 2) for raising and lowering in the tubing, and arms 27 pivotally connected to the body part 26 for swinging between the inner positions of FIGS. 1, 3 4, and 5, while disposed within the tubing, and the outer centering positions of FIGS. 2 and 6. As shown, there are two vertically spaced sets of arms for centering the tool when it is lowered to a position below the lower end of the tubing, although one set may be sufficient to center the tool if its upper end is retained in centered position within the lower end of the tubing. As indicated in FIGS. 1 and 2, an electronic instrument I or other object to be rigidly held in centered position within the tool is carried within the tool.

The upper end of each arm is pivotally connected by a pin 28 within a recessed portion 29 in the body and has a roller 31 pivotally connected by a pin 30 to its outer end for swinging between inner positions within the lower end of the recess and outer positions engaging the well bore. As shown, there are three such arms in each set, with the arms in each set being circumferentially spaced apart approximately 120 degrees to engage the well bore at equally spaced apart locations.

The upper end of each arm has gear teeth 32 formed thereon concentrically of the pivotal axis of the pin 28 and drivingly engageable with the teeth 33 of a rack. The racks for the three arms are formed on the sides of a triangularly shaped lower end 34 of a second body part 35 which is vertically reciprocable within the extension of an elongate opening 36 in the first body part in which the second body part is received. Thus, as best seen in FIGS. 9 and 10, the teeth 33 will move the arms in unison with one another between their inner and outer positions in response to vertical movement of the second body part 35. More particularly, downward movement of the body part 35 with respect to the the body part 26 will swing the arms toward their outer positions, while upward movement thereof with respect to the first body part will cause the arms to swing to their inner positions.

The upper end of the second body part is enlarged to fit closely within the opening 36, and a coil spring 37 therein yieldably urges the second body part to its lower position, and thus to a position for moving the arms to their outer positions. Thus, the coil spring is compressed between the upper end of the opening 36 in the first body part and an annular flange of the second body part connecting its upper and lower ends. The first and second body parts are held against relative rotation by a pin 26A on the first part received in a vertical groove 35A in the upper end of the second part, thereby retaining the teeth on the body parts in mesh.

As previously described, sensors 40 are carried by the first body part 26 for radial movement with respect thereto between the outer positions of FIGS. 3, 4 and 7 wherein their outer faces extend from the outer diameter of the body part 26, and inner positions, as shown in FIGS. 1, 5 and 8 wherein their outer surfaces are substantially flush with the outer diameter of the body part 26. More particularly, there two vertically spaced sets of sensors each for controlling the means by which the arms of a corresponding set are held in or released from their inner positions, with the sensors of each set being carried by the first body part in circumferentially spaced apart relation.

The sensors are received in holes 41 which connect with a groove 42 about the first body part 26 which, when the arms are in their inner positions, is disposed opposite a groove 43 about the upper end of the body part 35 in which a C-ring 44 is carried. More particularly, the C-ring is radially expandible and contractible, between an outer position which it normally assumes to urge the sensors to their outer sensing positions, and an inner position to which it is moved by the inwardly moving sensors as the sensors enter the bore 22 in the lower end of the well conduit.

More particularly, the C-ring is of such thickness that when expanded to its outer position, it is radially intermediate a shoulder 46 on the upper end of the groove 43 and a shoulder 47 on the lower end of the groove 42. Thus, in this expanded position, the C-ring limits downward movement of the second body part with respect to the first body part, and thus holds the arms against movement from their inner positions to their outer positions. On the other hand, upon contraction of the C-ring due to inward movement of the sensors upon entry into the bore 22, its outer diameter is within the shoulder 47 on the lower end of the groove 42, so that the second body part 35 is released to move downwardly with respect to the first body part 26 and thereby move the arms from their inner to their outer positions.

As shown in FIG. 3, as the tool moves within the normal inner diameter portion of the tubing, the arms are urged by springs 37 into engagement therewith and the lower end of the C-ring 44 is just above the shoulder 47 on the lower end of the groove 42. In the event the arms move into an enlargement within the well conduit, as shown in FIG. 4, they are permitted to move outwardly from the position of FIG. 3 only a limited extent by virtue of the fact that the lower end of the C-ring 44 moves into engagement with the shoulder on the lower end of the groove 42.

As the body moves into the lower end of the well conduit, and the sensors 40 enter the bore 22 therein, the sensors will be forced inwardly to move the C-ring to its contracted position in which it is free to move downwardly past the shoulder on the lower end of the groove 42. Although the spring 37 is urging the second body part 35 downwardly, the arms are not released for movement to their outer positions as long as they are also disposed within the bore 22, or within the somewhat large bore 23 for that matter. In fact, upon moving into the bore 22, the arms have been forced to their innermost inner positions, so as to in turn raise the body part 35 to its uppermost position in which the lower end of the C-ring 44 is its maximum distance above the upwardly facing shoulder on the groove 42.

It will thus be understood that, as previously mentioned, even in the event that the sensors 40 would move within a bore in the well conduit of the same diameter as the bore 22, the arms would not be free to move to their outer positions because they would be held in their inner positions by engagement with the bore 23, except in the unlikely event that the arms would be disposed opposite an enlargement within the well conduit at the same time the sensors 40 have entered a bore of the same diameter as the bore 22.

As the rollers 31 on the lower ends of the arms move beneath the lower end of the well conduit 21, the arms will be urged outwardly by the spring 37 so as to cause them to move to their outer positions, as shown in FIGS. 2 and 6. Thus, the contracted C-ring 44 is free to move with the body part 35 past the shoulder 47 on the lower end of the groove 42 and downwardly within the enlarged upper end of the opening in the body part 26.

The tool is so constructed that as the outer ends of the arms move outwardly into engagement with the well bore, it will occupy a positions as shown in FIG. 6, wherein the pivotal axis of the rollers 31 are below the pivotal axis of the pins 28. Also as shown in FIG. 6, the lower end of the flange on the body part 35 is so located with respect to the oppositely facing annular surface of the body part 26 as to engage same and thus prevent movement of the outer ends of the arms to an over center position in any case.

This of course is also useful in handling of the tool outside of the well conduit in that it maintains the arms in a position in which they may be easily collapsed into the recesses 29 so as to move the body part 35 to a position in which C-ring is above the shoulder 47 on the lower of the groove 42, and thus for expansion into a position holding the arms in their inner positions. As will be noted, the upper outer surfaces of the C-ring is tapered for sliding over a similarly shaped surface on the opening 36 in the body 26 just below the groove 42. (See FIG. 6A)

In order to retrieve the tool, it need only be raised by the wireline to cause the arms to engage the lower end of the well conduit and thus to be forced downwardly and inwardly to their inner positions. As the rollers move upwardly into the bore 22, as shown in FIG. 5, the C-ring 44 is moved with the second body part 35 to its position above the shoulder 47 on the lower end of the groove in the first body part. Even though the sensors 40 are in the bore 22, and thus force the C-ring inwardly, as also shown in FIG. 5, and the C-ring is there not in holding position as this stage of retrieval, the rollers of the arms remain engaged with the bore 22 until the sensors move upwardly out of the bore 22 and into portion 23 of the tubing. At this time, the sensors are forced to their outer positions by means of the C-ring 44, which in turn moves outwardly to its position in which its lower end is disposed above the lower end of groove 42. Thus, the arms are held against movement to their outer positions even though they may, during retrieval of the tool, be moved opposite an enlargement in the bore of the well conduit.

Although the above described tool is illustrated in connection with a vertical, or at least substantially vertical, well, it may of course be used in slanted or deviated well bores, or, for that matter, in horizontal sections of a well bore. Hence, the expressions "upper", "lower", "vertical", etc. are used only as reference points for other terms in the claims.

From the foregoing it will be seen that this invention is one well adapted to attain all of the end and objects hereinabove set forth, together with other advantages which are obvious and which are inherent to the method and apparatus.

It will be understood that certain features and subcombinations are of utility and may be employed without referred to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

I claim:

1. A tool which may be lowered within and raised from a centered position within a well bore beneath the lower open end of a well conduit within the well bore, comprising a wire line manipulatable body adapted to be moved vertically through the well conduit, a plurality of arms mounted on the body for movement between inner positions in which their outer ends may pass vertically through the well conduit and outer positions in which said outer ends engage the well bore in circumferentially space relation, means yieldably urging the arms toward their outer positions, means in addition to said arms for sensing the entry of the body into a bore of the well conduit near its lower end, and means for holding the arms in their inner positions, as the body is lowered within the well conduit and then when said sensing means is lowered into said bore, releasing said arms for movement by said urging means to their outer positions when said arms are below the lower end of the well conduit, said arms being forced to their inner positions when raised with the body against the lower end of the well conduit, and said holding means being returned to its arm holding position upon continued raising of the body to a position in which its sensing means moves above said bore.

2. A tool of the character defined in claim 1, wherein the body includes a first part on which the arms are mounted for movement between their inner and outer positions, a second part moveable with respect to the first part, and means connecting said second part to the arms for moving said arms to their outer positions upon movement in one direction with respect to the first part and to their inner positions upon movement with respect thereto in the opposite direction, said yieldable urging means acting between the first and second parts to urge the second part in said one direction.

3. A tool in claim 2, wherein the arms are pivotally mounted on the first body part, and said connecting means comprises gear teeth formed on each arm concentrically of its pivotal axis, and a rack on the second body part having gear teeth drivingly engageable with the gear teeth on each arm.

4. A tool in claims 2 or 3, wherein the outer end of each arm pivots in a direction upwardly and outwardly to its outer position and means are provided for limiting movement of the arms to positions in which their outer ends are below their pivotal axes.

5. A tool in claim 2, wherein the bore is of lesser diameter than that of the well conduit thereabove, the means for sensing entry into the bore comprises sensors carried by the first body part for movement between a position with respect to the outside of said first part, which said sensors assume when outside of the bore, and an inner position with respect thereto to which said sensors are forced by entry into the bore, and the arm holding and releasing means comprises means carried by the second body part for movement between holding position which it assumes when the sensors are in the outer positions and releasing position to which said holding and releasing means is forced when the sensors are in their inner positions.

6. A tool as in claim 5, wherein said means movable between holding and releasing positions is moveable between an expanded position in which said moveable means is disposed between oppositely facing shoulders on the body parts to limit movement of said second body part in said one direction, and a contracted position in which said movable means is free to move past the shoulder on the first part and thus permit said second part to move in said one direction, said means movable between expanded and contracted positions being opposite the sensors and normally assuming expanded position to urge the sensors outwardly to sensing position but permit the sensors to force said means movable between expanded and contracted positions inwardly to contracted position as the sensors enter the bore.

7. A tool in claim 6, wherein the first body part has a groove thereabout, the expandible and contractible means comprises a C-ring carried in the groove, the second body has a groove thereabout opposite the sensors, and the shoulders on the body parts are formed on the grooves therein.

8. A tool as in claim 7, wherein the shoulders are spaced a distance sufficiently greater than the vertical length of the C-ring that the ends of the arms are free to move out to engage a somewhat larger bore in the conduit without releasing the C-ring for movement past the shoulder in the first body part.

* * * * *